United States Patent [19]

Donovan

[11] 3,950,012

[45] Apr. 13, 1976

[54] RETAINER FOR MULTI-LEAFED DEVICES

[76] Inventor: Robert G. Donovan, 15 East Lane, Stauffer Heights, Pittston, Pa. 18640

[22] Filed: Mar. 17, 1975

[21] Appl. No.: 558,679

[52] U.S. Cl. ..... 281/46; 40/102

[51] Int. Cl.[2] ..... B42D 3/00

[58] Field of Search ..... 281/46; 40/104.07, 104.17, 40/102

[56] References Cited

UNITED STATES PATENTS

| | | | |
|---|---|---|---|
| 875,090 | 12/1907 | Meltzer et al. | 40/104.17 |
| 1,559,971 | 11/1925 | Meyer | 281/46 |
| 2,181,968 | 12/1939 | Ericson et al. | 281/46 |

FOREIGN PATENTS OR APPLICATIONS

| | | | |
|---|---|---|---|
| 137,755 | 4/1930 | Switzerland | 281/46 |
| 429,038 | 5/1935 | United Kingdom | 281/46 |
| 538,904 | 6/1955 | Belgium | 281/46 |
| 604,085 | 6/1948 | United Kingdom | 40/104.07 |
| 835,126 | 2/1970 | Canada | 40/104.17 |

*Primary Examiner*—Jerome Schnall
*Attorney, Agent, or Firm*—Whittemore, Hulbert & Belknap

[57] ABSTRACT

The retainer device is used for storage of multi-leafed devices such as magazines, pamphlets, notebooks and the like. Spaced apart brackets are provided either in a binder or secured to a stationary support surface. A plurality of spaced apart relatively long prongs extend from one bracket. A plurality of spaced apart shorter prongs extend from the other bracket. A multi-leafed device is stored in the retainer by first inserting the longer prongs into the center of the leaves until the opposite end of the device clears the shorter prongs. The device is then moved so that the shorter prongs are also inserted thereinto. The longer length of the first set of prongs permits this shifting action without disengaging the longer prongs.

3 Claims, 4 Drawing Figures

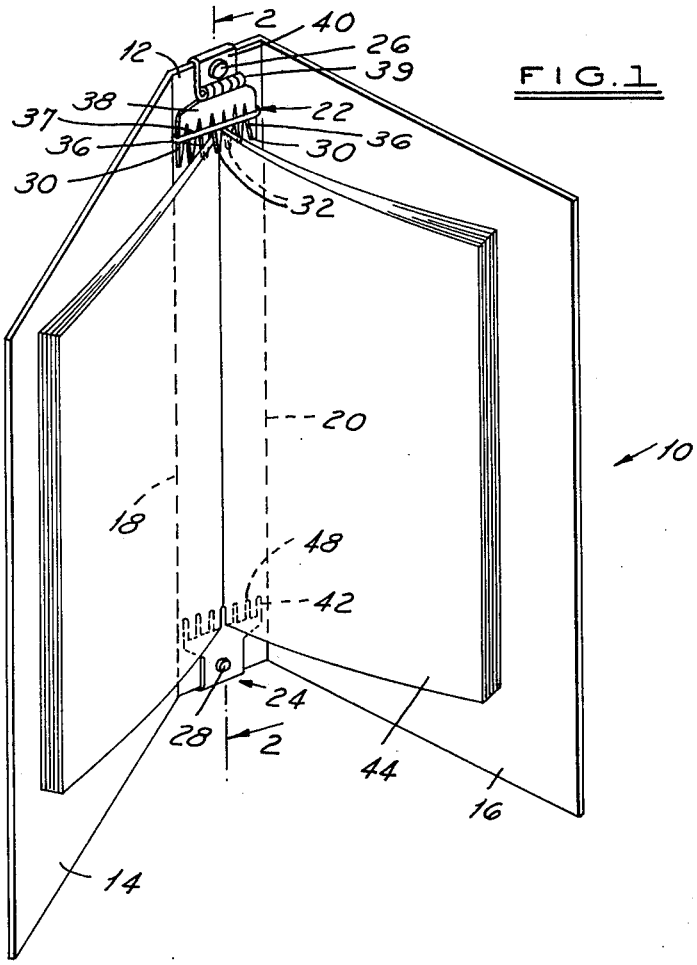
FIG. 1
FIG. 2
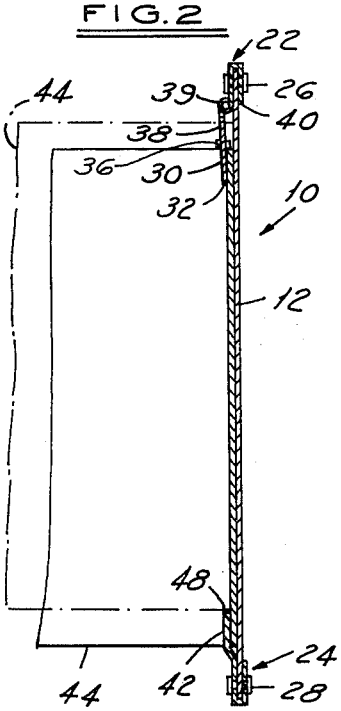
FIG. 3
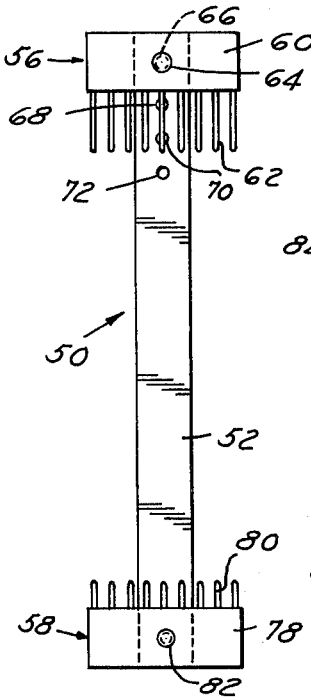
FIG. 4
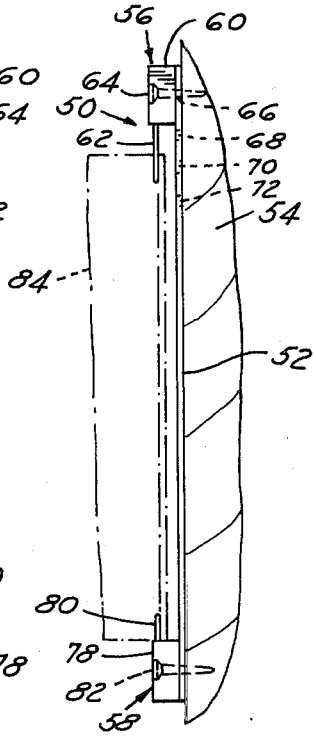

RETAINER FOR MULTI-LEAFED DEVICES

BACKGROUND OF THE INVENTION

Storage of multi-leafed devices such as magazines, pamphlets, catalogs, notebooks and the like has always been a problem. Such materials, when stored loosely, are somewhat unsightly and, more importantly, it is difficult to locate a particular issue when such materials are stacked. When it is attempted to store such materials in the conventional looseleaf binder, holes must be punched along the marginal edge portions. The punching of such holes is undesirable because it damages the materials and further the holes themselves may destroy some of the written material of the magazine, pamphlet and the like. Binders having parallel spaced apart wires which are removable for insertion into the centers of multi-leafed devices have also been provided for such materials. This type of binder is effective. However, such binders are somewhat expensive and insertion or removal of multi-leafed devices therefrom is time consuming.

In accordance with the present invention, a retainer, which may be in the form of a binder or a stationary rack, is provided for storage of multi-leafed devices. The retainer is relatively inexpensive to manufacture. Further, the retainer permits rapid insertion or removal of multi-leafed devices and does not require modifying such devices as by punching holes in them.

SUMMARY OF THE INVENTION

A retainer for a multi-leafed device is provided. The retainer includes an elongated support having a pair of spaced apart brackets secured thereto. Each bracket has a plurality of spaced apart prongs extending therefrom towards the other bracket. The prongs of one bracket are longer than the prongs on the other bracket. The distance between the tips of a pair of opposed prongs is less than the length of the multi-leafed device intended to be retained on the retainer.

IN THE DRAWING

FIG. 1 is a view in perspective of one embodiment of the retainer for multi-leafed devices in accordance with the present invention;

FIG. 2 is a sectional view taken substantially along the line 2—2 of FIG. 1 looking in the direction of the arrows;

FIG. 3 is a front elevational view of another embodiment of the invention which is a stationary unit fixedly mounted on a wall surface; and FIG. 4 is a side elevational view of the FIG. 3 embodiment.

Referring to FIGS. 1 and 2, it will be noted that a binder 10 is provided. The binder 10 has a relatively wide back 12 having covers 14, 16 extending therefrom. The covers 14, 16 may be flexed along hinge lines 18, 20 in the usual manner. The back 12 and covers 14, 16 of binder 10 are preferably fabricated of a relatively stiff material.

A bracket 22, 24 is provided at the upper and lower ends of the back 12. The brackets are secured to the back by means of rivets 26, 28.

The upper bracket 22 has a plurality of spaced apart downwardly extending prongs 30. The prongs 30 are narrow at their outer tips 32. The prongs, which are generally V-shaped, increase in width from the tip 32 to the base 34. A V-shaped space 36 is defined between each pair of adjacent prongs.

The prongs are supported on bracket portion 38 from which is hingedly attached by hinge structure 39 to a U-shaped section 40. Section 40 is received over the upper end of the back 12. The rivet 26 extends through section 40 to fixedly retain the bracket 22 in place.

The lower bracket 24 is constructed similarly to the upper bracket 22. However, the lower bracket differs in that the upwardly extending spaced apart prongs 42 are shorter than the prongs 30. Additionally, the prongs 42 are not V-shaped.

A magazine 44 is illustrated as being mounted in the binder 10. In mounting the magazine 44, it is first opened, preferably with an equal amount of leaves on either side as shown in FIG. 1. The magazine is mounted in the binder as shown in FIG. 2. As it will be noted in dotted lines, the magazine is first lifted upwardly for insertion on one of the prongs 30. Alternately, the magazine may first be dropped onto the lower prongs with the upper prongs being swung upwardly about hinge structure 39. The upper prongs are then swung into engagement with the magazine. The lower end of the magazine at this point clears the upper end of the lower prong 42. The magazine is then moved downwardly to the position illustrated in solid lines for retention in the binder 10. As it will be noted, the lower prong 42 is completely inserted into the magazine while the lower portion only of the upper prong is inserted into the magazine.

As previously mentioned, the upper prongs 30 are longer than the lower prongs 42. The dimensions must be such that the distance between the tips 32, 48 of the prongs is less than the length of the multi-leafed device intended to be mounted in the binder. The upper prongs 30 must be longer than the lower prongs 42 by a length sufficient to provide a lower portion of the prongs 30 adequate for support of a multi-leafed device after the device has been mounted as illustrated in FIG. 2.

The magazine 44 will not inadvertently fall out of the binder 10 even if the binder 10 is tipped upside down. This results from the frictional engagement of the binder as a consequence of the V-shaped spaces 36 between each pair of adjacent prongs. In one actual model, the prongs 30 were 1/16 inch wide at the tip and ⅛ inch wide at the base. Similar frictional engagement may be obtained by increasing the width of the prongs 30 so that a narrow space only exists between each pair of adjacent prongs. However, it is desirable to have a narrow portion at the outer or tip end 32 of the prongs 30 in order for easy insertion into the multi-leafed device. Additionally, a plastic or metallic clip 37 may be provided to snap on over the upper prongs 30 to prevent movement of the magazine 44 after it has been mounted. A spring may also be stretched over the prongs for this purpose.

FIGS. 3 and 4 illustrate a wall-mounted version of a retainer. The retainer 50 includes an elongated support element 52 adapted for securement to a wall 54. Upper and lower brackets 56, 58 are provided. The upper bracket 56 comprises a body 60 having downwardly extending spaced apart prongs 62. The body 60 has an opening therethrough for insertion of a screw 64. A plurality of spaced apart openings 66, 68, 70, 72 are provided in the upper portion of support element 52. The upper bracket 56 may be mounted at the location of any one of these openings to thereby vary the spacing relative to the lower bracket 58 to provide for mounting of multi-leafed devices of different sizes.

The lower bracket 58 also consists of a body 78 having upwardly extending spaced apart prongs 80. The body 78 has an opening therethrough as does the lower end of the support element 52 for reception of a screw 82 for securement of the lower end of the retainer to the wall 54. As in the FIG. 1 embodiment, the upper prongs 62 are longer than the lower prongs 80 and the spacing between the tips of the prongs again is less than the length of the multi-leafed device intended to be mounted on the retainer. As shown in dotted lines in FIG. 4, the multi-leafed device 84 is mounted on the retainer 50 in the manner shown in FIG. 1. It is not necessary that the upper prongs be spaced to frictionally hold the device 84 because the retainer 50 is permanently secured in an upright position.

Having thus described my invention, I claim:

1. The combination comprising a retainer for a multi-leafed device and a multi-leafed device, said retainer comprising an elongated support comprising the back of a binder having cover elements, a pair of spaced apart brackets secured to the support, one of said brackets being an upper bracket and the other of said brackets being a lower bracket, each bracket having a plurality of spaced apart prongs extending therefrom towards the other bracket, each of the prongs on the upper bracket being longer than each of the prongs on the lower bracket, the distance between the tips of a pair of opposed prongs being less than the length of the multileafed device retained on the retainer while said distance plus the length of the prongs on the upper bracket is greater than the length of said multi-leafed device and said distince plus the length of the prongs on the lower bracket is less than the length of said multi-leafed device, and stop structure on the prongs of said upper bracket which is movable on the prongs of the upper bracket from a position to prevent inadvertent release of said multi-leafed device on the retainer to a position allowing release of said multi-leafed device.

2. The combination of a retainer and a multi-leafed device as defined in claim 1, further characterized in that the distance between each adjacent pair of prongs on said upper bracket which are longer than the prongs on the lower bracket is narrow enough for frictional retention of the leaves of the multi-leafed device retained on the retainer.

3. The combination of a retainer and a multi-leafed device as defined in claim 1, further characterized in that the prongs on said upper bracket which are longer than the prongs on the lower bracket are wider at their base than at their tip so as to define a V-shaped space between each pair of adjacent prongs for frictional retention of the leaves of the multi-leafed device retained on the retainer.

* * * * *